US005105964A

United States Patent [19]

Heath

[11] Patent Number: 5,105,964

[45] Date of Patent: Apr. 21, 1992

[54] BEVERAGE CAN CAP

[76] Inventor: William D. Heath, Box 99, Rte. 23, Davenport, N.Y. 13750

[21] Appl. No.: 604,516

[22] Filed: Oct. 29, 1990

[51] Int. Cl.[5] ..... B65D 51/18

[52] U.S. Cl. ..... 220/254; 220/258; 220/306; 220/636; 220/737

[58] Field of Search ..... 220/258, 355, 356, 90.4

[56] References Cited

U.S. PATENT DOCUMENTS

| | | | |
|---|---|---|---|
| 4,190,174 | 2/1980 | Haimowitz | 220/254 |
| 4,194,645 | 3/1980 | Zabner et al. | 220/306 |
| 4,209,107 | 6/1980 | Crisci | 220/306 |
| 4,350,260 | 9/1982 | Prueher | 220/254 |
| 4,749,100 | 6/1988 | Eberhart | 220/306 |
| 4,752,016 | 6/1988 | Eads | 220/253 |
| 4,917,258 | 4/1990 | Boyd et al. | 220/240 |
| 4,930,654 | 6/1990 | Thibeault et al. | 220/253 |
| 4,938,379 | 7/1990 | Kellner | 220/370 |
| 4,961,510 | 10/1990 | Dvoracek | 220/90.4 |
| 4,969,572 | 11/1990 | van Kerkhoven et al. | 220/253 |

*Primary Examiner*—Stephen Marcus
*Assistant Examiner*—Vanessa Caretto

[57] ABSTRACT

A beverage can cap for protecting the drinking area of a beverage can from becoming unsanitary including a resilient cap which fits to the tapered upper portion of the beverage can with an internal annular groove to fit within the inside vertical lip on the top of the beverage can and having a protrusion in its internal surface to fit beneath the external bead of the beverage can to retain the cap in place on the beverage can.

9 Claims, 1 Drawing Sheet 11
13
15
17
19
21
23
25
27
29
30
31
32
33
35
37
39
41
43
45
47
49
51
53
55

BEVERAGE CAN CAP

BACKGROUND OF THE INVENTION

This invention relates to a beverage can cap for beverage cans to protect the drinking area of a beverage can from impurities.

Beverage cans with the familiar sealed snap opening are commonplace. Such cans are frequently sold in six packs held together by a plastic loop connector. Consumers, frequently when not at home, purchase such beverage cans and drink from them directly. The beverage cans are designed with a tapered upper portion to fit the lips of the consumer and the snap opening is shaped and located for easy drinking from the beverage can with out aid of either a straw or glass.

Unfortunately, during transportation and storage, such beverage cans, including the drinking area, may become contaminated resulting in an unsanitary condition.

The beverage can cap envisioned by this invention is placed securely upon the beverage can immediately upon filling when the beverage cans can be readily washed and sanitized. The beverage cap is attractive in appearance and can be easily used for advertising purposes. The usual plastic straps used to hold a six pack together are not interfered with in any way. The beverage can cap can be readily forced off the can when dispensing from the beverage can is desired, but will not fall off during transportation or storage. The beverage can cap can be used to recover the top if only a portion of the beverage is used at one time. The beverage can cap may, during drinking be placed on the bottom of the can for safe keeping and to retain the clean condition of the beverage can cap.

Economy of production as well as ease of use are provided by this invention which provides protection of the sanitary condition of the drinking area from filling of the beverage can to use and preservation of the sanitary condition between usage as well as a sealing of the beverage can between repeated usage.

SUMMARY OF THE INVENTION

In accordance with the present invention, there is provided a cap to protect a beverage can from being contaminated at the drinking area of the beverage can.

Beverage cans usually have a recessed top surrounded by a vertical lip. A sealed edge by which the top of the beverage can is secured to the upper edge of the sidewalls of the beverage can is located on the outside of the vertical lip. The upper portion of the sidewalls of a beverage can are usually tapered to a reduced diameter to provide a comfortable place for the lips of a consumer drinking from the beverage can. The cap has an upper surface which is circular and has an annular groove adjacent the outside edge of the cap to fit within the vertical lip of the beverage can. The cap has a skirt which extends from the upper surface. The skirt has the tapered configuration of the beverage can. Along the internal surface of the skirt and adjacent the lower portion of the annular groove is a projection means which extends inwardly to press against the beverage can and catch beneath the sealed edge. The projection means holds the cap in the beverage can but the cap has sufficient resiliency to permit it to be readily pulled off the can. p The beverage can cap, which may readily be used for advertising, may be replaced on the top of the beverage can if only a portion of the beverage is consumed at one time. The cap may be stored on the base of the can when consuming the beverage and in this way the cleanliness of the beverage can cap is protected.

The novel features which are considered as characteristics of the invention are set forth with particularity in the appended claims. The invention itself, however, as to its construction and obvious advantages, will be best understood from the following description and the specific embodiment when read with the accompanying drawings.

DETAILED DESCRIPTION OF THE INVENTION

Figures 1, 2, 3, 4:
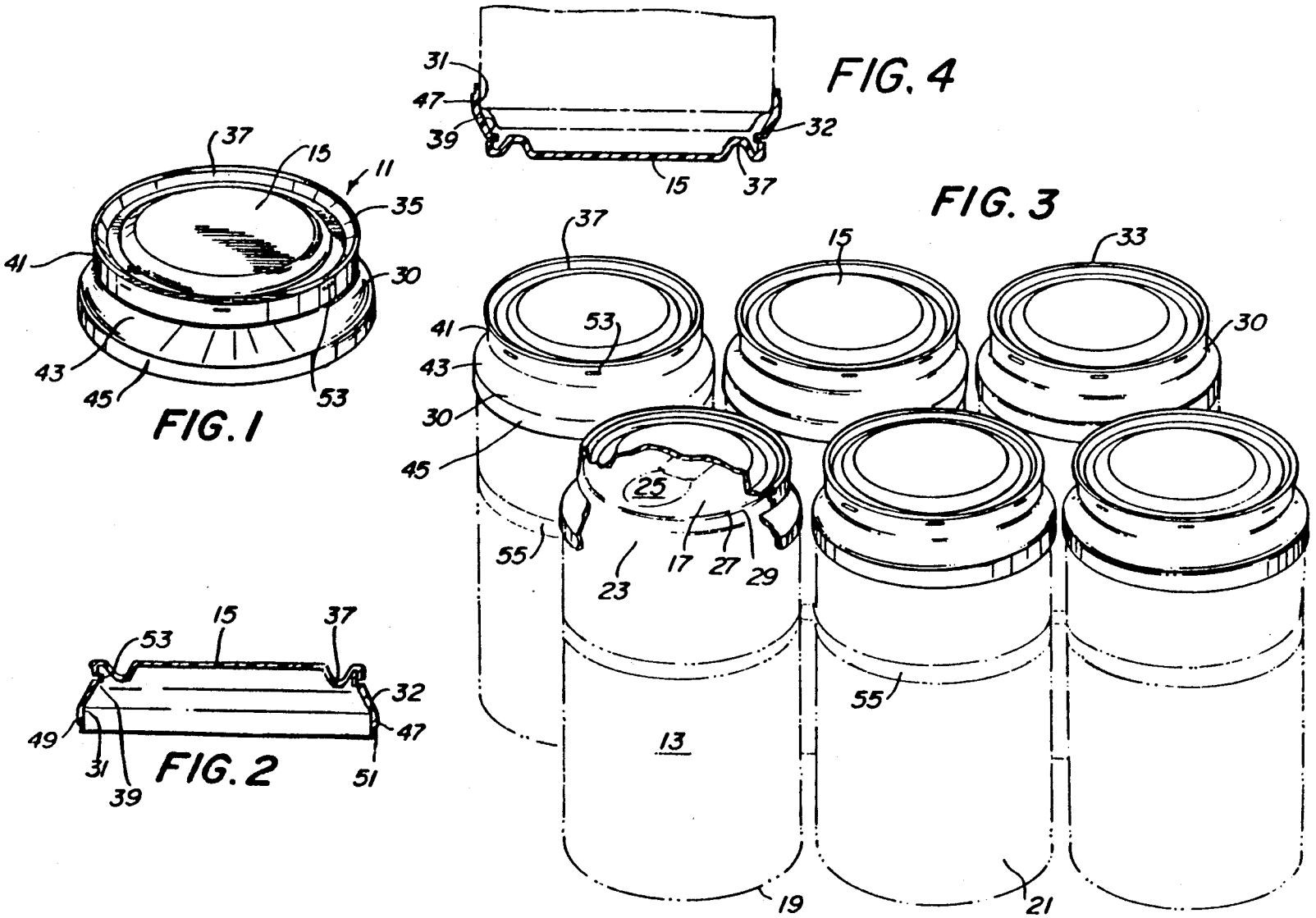
FIG. 1 is a pictorial view of the cap.
FIG. 2 is a cross sectional view of the cap.
FIG. 3 is a pictorial view of a six pack of beverage cans shown in broken lines with each of the six beverage cans within the six pack having a beverage cap affixed to it, but with one of the six beverage caps partially broken away to show the upper end beverage can.
FIG. 4 is a pictorial view showing the cap affixed to the bottom of the can.

The same reference numerals are used throughout the drawings and specification to note a similar item of the invention.

Referring now to FIGS. 1 and 3, the beverage can cap 11 for use on a beverage can 13 is seen with an upper surface 15 which is circular In FIG. 3, where the beverage can cap 11 is shown broken away, the top 17 of a beverage can 13 is seen. Such beverage cans 13 are well known in the art, but need to be described to show the basis for the details of the beverage can cap 11.

The beverage can 13 has a top 17 and a bottom 19 as well as sidewalls 21. The upper portion 23 of the sidewalls 21 are tapered to provide a readily useable place for the consumer to place his or her lips and permit easy drinking from the beverage can 13. The beverage can cap 11 is generally shaped to fit the upper portion 23 of the beverage can 13. A beverage can 13 such as would be suitable for use of the beverage can cap 11, contemplated by this invention, usually has a snap opening 25 in its top 17. The top 17 of the beverage can also has a vertical lip 27 which is annular and surrounds the top 17 of the beverage can 13. The vertical lip 27 of the beverage can 13 is wrapped over the upper edge of the sidewalls 21 of the beverage can 13 forming an external bead 29. The top 17 of the beverage can 13 and the snap opening 25 are recessed within the vertical lip 27.

The beverage can cap 11 has the upper surface 15 which is circular. A skirt 30 extends downwardly from the outside edge or circumference 35 of the upper surface 15 and has an inside surface 31 and an outside surface 32.

As can best be seen in FIG. 2, adjacent the outside edge or circumference 35 of the upper surface 15, there is an annular groove 37 in the upper surface 15 of the beverage can cap 11. The skirt 31 and the annular groove 37 form an annular space 39 which fits over the vertical lip with the annular groove 37 located inside the vertical lip and the skirt 30 outside the vertical lip 27. The upper surface 15 of the beverage can cap 11 lies in a parallel plane above the top 17 of the beverage can 13 which provides space for the snap opening 25 of the beverage can 13.

The skirt 30 of the beverage can cap 11 includes three sections, namely an upper section 41 which is cylindrical and which is joined to the upper surface 15, an intermediate 43 section which is flared and which extends both downwardly and outwardly from the upper section 41 to which it is joined and a lower section 45 which is cylindrical and which is joined to and extends downwardly from the intermediate section 43. The upper section 41 and the lower section 45 are aligned substantially at right angles to the upper surface 15 and are generally concentric with one another but the lower section 45 has a greater diameter than the upper section 41 and the intermediate section 43 joins together the upper section 41 and the lower section 45. The lower section 45 has an upper portion 47 and a lower portion 49. The upper portion 47 has a thickness generally consistent with the thickness of the intermediate section 43 upper section 41 and upper surface 15, but the lower portion 49 has a reduced thickness, the approximately outer-half of the thickness of the lower section 45 being removed. As a result, the inner surface of the lower section 45 is continuous, but the outer surface of the lower section 45 has a step 51. This step 51 provides greater flexibility in the lower section 45 for removing the beverage can cap 11 from a beverage can 13.

On the inside of the upper section 41 is a projection means 53 which extends internally within the cap beverage can 11. The projection means 53 may be a series of nodes, preferably eight in number and preferably equally-spaced about the inside of the upper section 41. In the alternative, an internal ring may be used for the projection means 53 but any sufficient number of internal node or a ring will produce the desired result. Each node or the ring is actually a small projection extending inwardly from the inside wall of the upper cylindrical section. The nodes may also be formed by pressing in on the inside of the upper section 41 with a blunt instrument. The projection means 53 is located just below the bottom of the annular groove 37 and generally along the mid-section of the upper section 41.

When the beverage can cap 11 is pressed down on the top 17 of the beverage can 13 the projection means 53 is forced beneath the external bead to hold the cap on the beverage can. By a user placing his or her fingernails beneath the lower portion 49 of the lower section 45 and applying limited force, the projection means 53 is forced back over the external bead 29.

As can be readily seen in FIG. 3, the lower section 45 fits over the sidewalls 21 of the beverage can 13. The intermediate section 43 and the upper section 41 do not fit over the sidewalls 21 of the beverage can 13. The skirt 30 or more specifically, the lower section 45 fits over the bottom 19 of the beverage can 19. For this reason, when the beverage is being consumed from the beverage can 13, the beverage can cap 11 may readily be placed on the bottom 19 of the beverage can 13. Since only the lower section 45 fits about the sidewalls 21 of the beverage can 13, the upper section 41 and the intermediate section 43 are away from the bottom 19 of the beverage can 13. In this way, the inside of the intermediate section 43 and the upper section 41 and most importantly the upper surface 15 of the beverage can cap 11 are protected from contact with the beverage can 13 and possible contamination. Since the inside of the beverage can cap 11 is closed by the bottom 19 of the beverage can 13, contamination from sources in the general environment are also prevented.

If the user or consumer of the beverage in the beverage can 13 does not wish to consume the entire contents of the beverage can 13 at one time, the beverage can cap 11 may be easily re placed on the top 17 of the beverage can 13. As is well known, the snap opening 25, once opened, cannot be reclosed. By placing the beverage can cap 11 back on the top 17 of the beverage can 13, the beverage can 13 is resealed, retaining the beverage in the beverage can 13 pending further consumption.

When the beverage cans 13 are secured, together by a strap 55, which is well known, as shown in FIG. 3, the beverage can cap 11 can be installed without any interference with the strap 55.

The invention may be embodied in other specific forms without departing from the spirit or essential characteristics thereof. The present embodiments are therefore, to be considered in all aspects as illustrative and not restrictive. The scope of the invention is indicated by the appended claims rather than the foregoing description and all changes which come within the meaning and range of equivalency of the claims are therefore intended to be embraced therein.

I claim:

1. A beverage can cap of resilient material for use on a beverage can of generally cylindrical shape with a tapered upper portion and having a top and a bottom and having a vertical lip and an external bead around the top of the beverage can, such cap comprising:

an upper surface having a generally circular shape and with a generally annular groove adjacent the outside edge of the upper surface; and a skirt extending downwardly from the upper surface and having an inside surface and an outside surface and including an upper section having a cylindrical shape, an annular space being formed between the annular groove and the inside surface upper section to fit over the vertical lip around the top of the beverage can, the inside surface of the upper section including a projection means to press against the beverage can beneath the external bead of the can, said skirt further including an intermediate skirt which is flared outwardly and downwardly from the upper section and a lower section which is cylindrical extending from the intermediate skirt, the lower section having an upper portion and a lower portion beneath the upper portion, the lower portion of the lower cylinder having less thickness than the upper portion, the lower section also to fit over the bottom of the beverage can.

2. A cap according to claim 1 wherein the projection means is a plurality of nodes.

3. A cap according to claim 1 wherein the projection means is an internal ring.

4. A cap of resilient material for use on a beverage can of generally cylindrical shape with a tapered upper portion and having a top and a bottom and having a vertical lip and an external bead around the top of the beverage can, such cap comprising:

an upper surface with an annular groove adjacent the outside edge of the upper surface;

a skirt extending downwardly from the upper surface and being flared to fit the tapered upper portion of the beverage can, said skirt having an inside surface and an outside surface, the inner surface of the skirt including a projection means to press against the beverage can beneath the external bead of the can, said skirt also to fit over the bottom of the can.

5. A cap according to claim 4 wherein the projection means is a plurality of nodes.

6. A cap according to claim 4 wherein the projection means is annular ring.

7. A beverage can cap of resilient material for use on a beverage can of generally cylindrical shape with a tapered upper portion and having a top and a bottom and having a vertical lip and an external bead around the top of the beverage can, such cap comprising:

an upper surface having a generally circular shape and with a generally annular groove adjacent the outside edge of the upper surface; and a skirt extending downwardly from the upper surface and having an inside surface and an outside surface and including an upper section having a cylindrical shape, an annular space being formed between the annular groove and the inside surface upper section to fit over the vertical lip around the top of the beverage can, the inside surface of the upper section including a projection means to press against the beverage can beneath the external bead of the can, said skirt further including an intermediate skirt which is flared outwardly and downwardly from the upper section and a lower section which is cylindrical extending from the intermediate skirt, the lower section also to fit over the bottom of the beverage can.

8. A cap according to claim 7 wherein the projection means is a plurality of nodes.

9. A cap according to claim 7 wherein the projection means is an internal ring.

* * * * *